United States Patent [19]

Ueda et al.

[11] Patent Number: 5,052,471

[45] Date of Patent: Oct. 1, 1991

[54] METHOD OF RAPIDLY AND UNIFORMLY WIDTHWISE COOLING CAST STAINLESS STEEL STRIP IN CONTINUOUS CASTING

[75] Inventors: Masanori Ueda; Shinichi Teraoka, both of Kitakyushu, Japan

[73] Assignee: Nippon Steel Corporation, Tokyo, Japan

[21] Appl. No.: 536,432

[22] Filed: Jun. 8, 1990

[30] Foreign Application Priority Data

Jun. 23, 1989 [JP] Japan ..... 1-159733

[51] Int. Cl.[5] ..... B22D 11/06; B22D 11/124

[52] U.S. Cl. ..... 164/480; 164/485

[58] Field of Search ..... 164/428, 480, 477, 485, 164/476, 417

[56] References Cited

FOREIGN PATENT DOCUMENTS 63-68248 3/1988 Japan .
63-19258 4/1988 Japan .
1-133651 5/1989 Japan ..... 164/428

OTHER PUBLICATIONS

Patent Abstracts of Japan, vol. 13, No. 258 (M-838) [3606], Jun. 15, 1989.
Patent Abstracts of Japan, vol. 13, No. 380 (M863) [3728], Aug. 23, 1989.
Patent Abstracts of Japan, vol. 12, No. 376 (M-750) [3223], Oct. 7, 1988.
European Search Report EP 90 11 1663.

*Primary Examiner*—Kuang Y. Lin
*Attorney, Agent, or Firm*—Kenyon & Kenyon

[57] ABSTRACT

A method of rapidly and uniformly widthwise cooling a cast stainless steel strip when casting the strip by using a vertical type twin-roll continuous caster provided with a pair of cooling rolls having an outer circumferential surface composing a casting mold wall moving synchronously with the cast strip, which comprises the step of: pressing a cast strip having left a kissing point between the cooling rolls against the circumferential surface of one of the cooling rolls with a press roll disposed downstream of the kissing point and having a press roll surface geometry predetermined in accordance with a cooling roll crown and a cast strip crown, to rapidly cool the cast strip over the entire strip width, successively from the strip solidification completion and over a temperature range in which the growth of solidified grains of the strip is accelerated.

4 Claims, 3 Drawing Sheets

METHOD OF RAPIDLY AND UNIFORMLY WIDTHWISE COOLING CAST STAINLESS STEEL STRIP IN CONTINUOUS CASTING

BACKGROUND OF THE INVENTION

1. Field of the Invention

The present invention relates generally to the production of a cold-rolled stainless steel strip from a continuous-cast steel strip, and more specifically, to a method of rapidly and uniformly widthwise cooling a cast stainless steel strip having a thickness close to that of a cold-rolled stainless steel strip product when producing such a cast strip by using a synchronous type continuous caster in which there is no relative speed difference between a cast strip and an inside wall of a casting mold, particularly a vertical type twin-roll continuous caster. In this method, a cast strip having passed through a "kissing point" or a gap between a pair of cooling rolls is subsequently rapidly cooled by being kept in contact with one of the cooling rolls, to produce a fine-grained cast strip which is advantageously used as a material for producing a cold-rolled stainless steel strip having a superior surface quality.

2. Description of the Related Art

In the conventional manufacture of cold-rolled stainless steel strips by using a continuous casting process, a 100 mm or more thick steel slab is cast by using a oscillating mold, and the cast slab is then surface-finished, heated to a temperature of 1000° C. or higher in a heating furnace, and hot-rolled by a hot strip mill consisting of a rough roll array and a finishing roll array to form a hot strip several mm thick.

Before cold rolling, the thus-obtained hot strip is annealed to soften the heavily hot-worked structure thereof, and surface scale, etc., is removed by pickling followed by grinding, to ensure the cold-rolled shape or flatness, the mechanical property, and the surface quality required for a final cold-rolled strip product.

The conventional process requires lengthy facilities for hot rolling and a vast amount of energy is consumed for heating and working a material, and further, this process is disadvantageous from the viewpoint of efficiency. The use of the product sheet is also limited in many respects, for example, anisotropy must be taken into consideration when working the sheet by press working, etc., because of a sheet texture which has been well-developed by many working steps during the process of forming a 100 mm or more thick cast slab into a final cold-rolled strip.

To solve the problem of the lengthy facilities for hot rolling, the vast amount of energy consumed, and the rolling power required to roll a 100 mm or more thick slab to form a hot strip, studies were recently carried out on a process in which a continuous casting provides a cast strip having a thickness substantially equivalent to or close to that of a hot strip. For example, special reports in "Tetsu-to-Hagane", 1985, pages A197 to A256 disclosed processes in which such a cast strip is directly obtained by a continuous casting. In these reports, use of a twin-roll type continuous casting is considered for obtaining a cast strip having a thickness of 1 mm to 10 mm.

These continuous casting processes, however, have problems in the casting step per se, and do not provide an effective solution to the problems of the mechanical properties and surface quality.

In these new and developing processes in which the continuous casting provides a cast strip having a thickness equivalent or close to that of a hot strip, the process from casting to a final product strip is simplified, or several process steps are omitted, with the result that the surface property of a final cold-rolled strip is easily affected by the cast strip quality. Namely, a good cast strip is required to obtain a final cold-rolled strip having a superior surface quality.

Special care must be taken to prevent a nonuniform luster and a surface defect called "roping", which are peculiar to cold-rolled stainless steel strips and commercially devalue the product sheet.

The occurrence of surface defects such as roping has a close relationship to a coarsening of the solidified structure of a cast strip. In the vertical type twin-roll continuous caster, a cast strip is separated from the cooling rolls as it leaves the kissing point between the cooling rolls, and thus is no longer rapidly cooled by a metal contact with the cooling rolls but is only air-cooled. Accordingly, a cast strip stays for a longer time at high temperatures at which the grain growth is accelerated, to cause a grain coarsening of the cast strip and surface defects of the final product strip. Therefore, it is very important to rapidly cool the cast strip which has passed through the kissing point, to prevent a coarsening of the cast structure.

To ensure the rapid cooling of a cast strip, it is most effective to keep a cast strip in contact with the cooling surface or the outer circumferential surface of a cooling roll after the cast strip has passed through the kissing point.

To this end, Japanese Examined Patent Publication (Kokoku) No. 63-19258 (hereinafter referred to as "Publication (1)") proposed a process in which a cast strip is kept in contact with the cooling roll surface by being imparted with a tensile force, and Japanese Unexamined Patent Publication (Kokai) No. 63-68248 (hereinafter referred to as "Publication (2)") proposed a process in which a plurality of auxiliary water-cooled rolls are disposed along the circumference of a main cooling roll so that a cast strip is cooled as it moves between the main and auxiliary cooling rolls.

These proposals may be effective in the case of a cast strip in the form of a ribbon and having a relatively small width, but the following basic problem arises when they are adopted in the production of a cold-rolled stainless steel strip having a large width, for which a cast strip must also have a large width.

The cooling roll of a continuous caster has flow paths for a coolant water provided inside the roll, and therefore, has a significantly lower rigidity and a greater thermal distortion in comparison with other rolls such as rolling rolls. Namely, the cooling rolls unavoidably have a structure such that both ends of the cooling roll body have a high rigidity as a support which imparts a rigidity to the whole body of a roll, but the intermediate portion of the roll body length has a lower rigidity. Accordingly, the diameter of the intermediate portion of the roll body is relatively expanded when the roll temperature is raised and relatively contracted when the roll temperature is lowered, so that the roll crown or roll curve is significantly varied by changes in the roll temperature.

As a hot, cast strip moves down and is separated from the roll surface at the kissing point, the roll temperature in the portion below the kissing point is lowered to cause a sharpening of the roll crown curvature in that portion in comparison with the roll crown curvature of the portion above the kissing point or at the portion in contact with the hot cast strip. The cast strip crown or the curvature across the strip width is determined by the roll crown of the roll portion above the kissing point and having a less sharp curvature. Accordingly, if the cast strip moving down out of the kissing point and having a less sharp crown is simply brought into contact with the roll surface situated below the kissing point and having a sharper curvature, only the side edge portions of a cast strip are actually brought into contact with the longitudinal ends of the cooling roll, and therefore, a rapid cooling over the entire width of cast strand cannot be effected.

The previously mentioned Japanese Patent Publications (1) and (2) do not take the above problem into consideration and are therefore unsatisfactory as a method of rapidly cooling a cast strip to prevent surface defects of the cold-rolled stainless steel strips. In the method of Publication (1), it is possible to increase the tensile force to an extent such that the intermediate portion of the strip width can be also brought into contact with the cooling roll surface, but in such a case, an extremely large tensile force would be loaded on the just-solidified cast strip at the kissing point, to cause the danger of, for example, a rupture of the cast strip. Thus, the method of Publication (1) cannot be practically adopted.

SUMMARY OF THE INVENTION

The object of the present invention is to provide a method of cooling a cast strip rapidly and uniformly widthwise over the entire width of the strip, successively from the solidification of the strip and over the temperature range in which the solidified grains rapidly grow, to prevent the coarsening of the solidified structure of a cast strip being cast by a vertical type twin-roll continuous caster.

To achieve the object according to the present invention, there is provided a method of rapidly and uniformly widthwise cooling a cast stainless steel strip when casting the strip by using a vertical type twin-roll continuous caster provided with a pair of cooling rolls having an outer circumferential surface composing a casting mold wall moving synchronously with the cast strip, which comprises the step of:

pressing a cast strip having left a kissing point between the cooling rolls against the circumferential surface of one of the cooling rolls with a press roll disposed downstream of the kissing point and having a press roll surface geometry predetermined in accordance with a cooling roll crown and a cast strip crown, to cool said cast strip rapidly over the entire strip width, successively from the strip solidification completion, and over a temperature range in which the growth of solidified grains of the strip is accelerated.

DESCRIPTION OF THE PREFERRED EMBODIMENT

Figure 1:
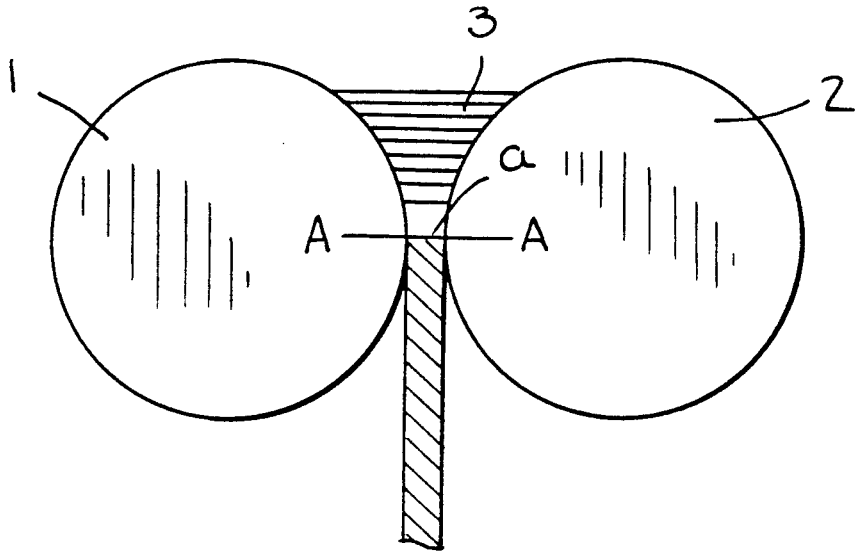
Fig. 1. PRIOR ART
FIG. 1 is a vertical sectional view showing a conventional arrangement for continuous casting using a vertical type twin-roll continuous caster not provided with a press roll.
Figure 2:
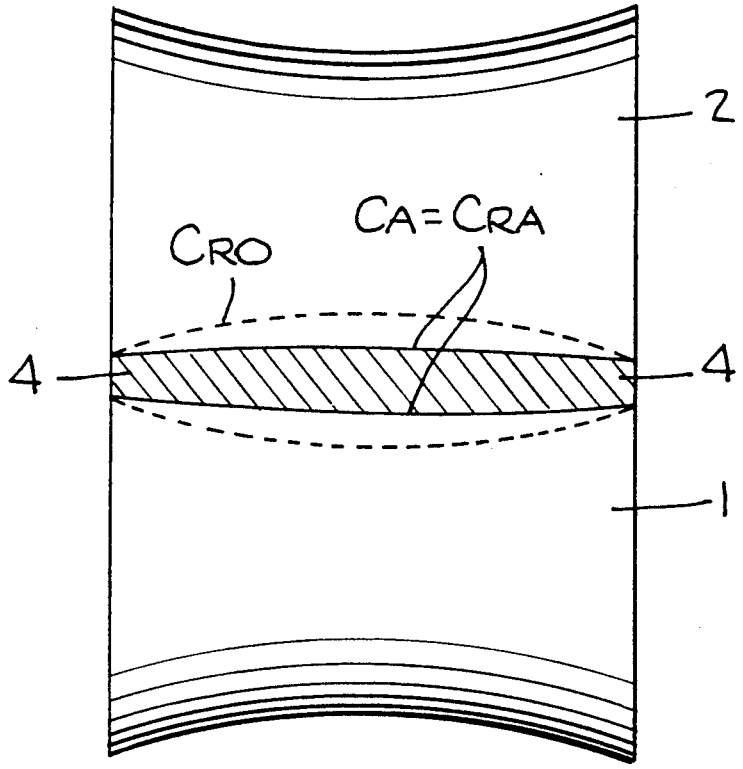
FIG. 2 is a horizontal section along the line A—A of FIG. 1 or 3, showing the interrelationship between the cooling roll crown and the cast strip crown.

In the conventional continuous casting using a vertical type twin-roll continuous caster as shown in FIG. 1, a molten metal 3 is poured into a casting mold defined by a pair of cooling rolls 1 and 2 and a pair of not-shown side dams, in which mold the cooling rolls 1 and 2 extract heat from the molten metal 3 to solidify same and form a cast strip 4, the solidification being substantially completed over the entire strip thickness when the strip 4 leaves a kissing point "a" between the cooling rolls 1 and 2. It can be seen from FIG. 2 that, during the forming of the cast strip 4, a cooling roll crown $C_{RA}$ at the kissing point "a" determines the necessary cast strip crown $C_A$ or the transversesectional profile of the cast strip 4. Therefore, the cooling rolls 1 and 2 have a roll crown $C_{RA}$ when heated to a temperature in the region of the kissing point "a" (hereinafter referred to as "kissing point temperature") to form a predetermined cast strip crown $C_A$. Namely, at temperature lower than the kissing point temperature, the cooling rolls 1 and 2 have a crown $C_{RO}$ which has a sharper curvature than $C_{RA}$ ($=C_A$) due to a relative thermal contraction of the longitudinally intermediate portion of the cooling roll body.

Figure 3:
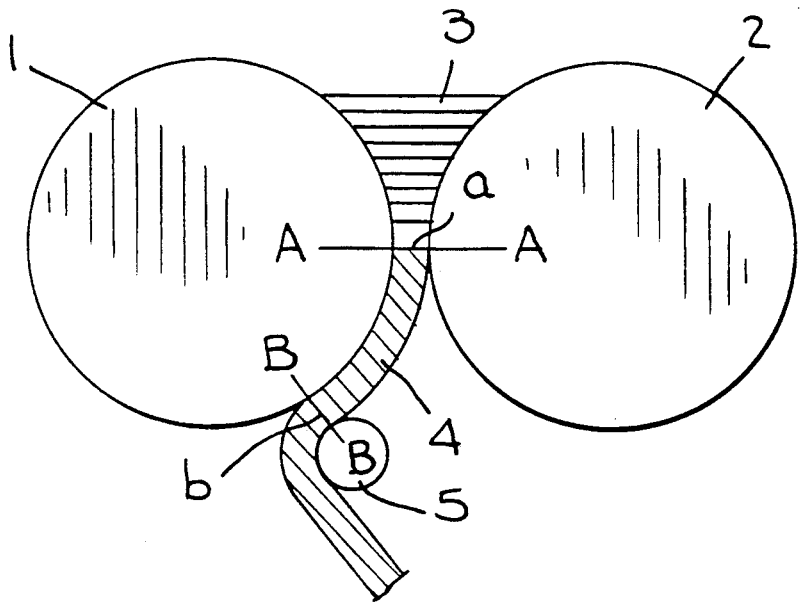
FIG. 3 is a vertical sectional view showing an arrangement for continuous casting using a vertical type twin-roll continuous caster provided with a press roll, according to the present invention.
Figure 4A:
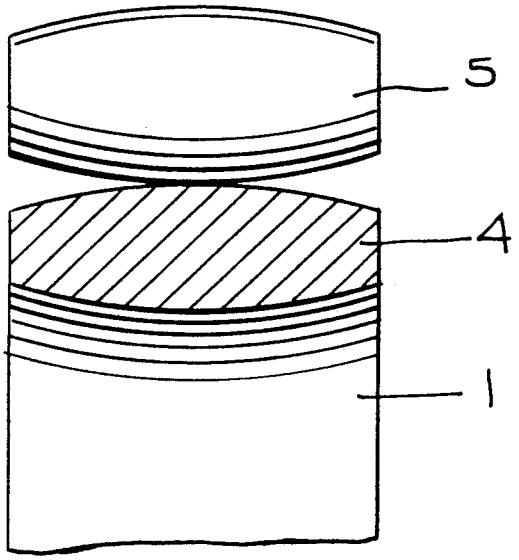
FIG. 4 schematically shows a cast strip pressed against a cooling roll by using (a) a convex-crowned press roll or (b) a straight press roll capable of being bent to form a required roll crown, according to the present invention.
Figure 4B:
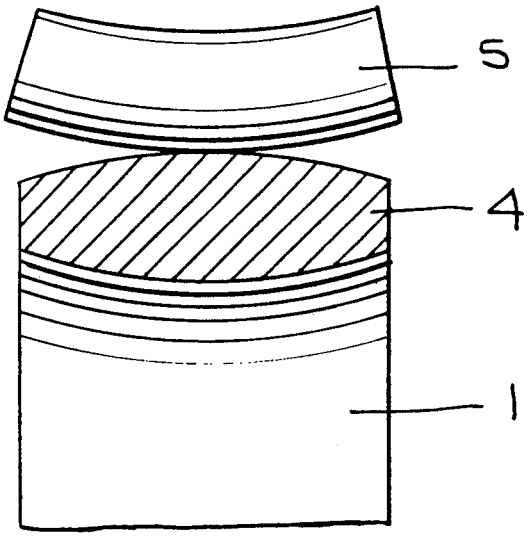

FIG. 3 shows an arrangement of a vertical type twin-roll continuous caster according to the present invention, in which a cast strip 4 having left the kissing point "a" is pressed against one of the cooling rolls 1 and 2 (or the cooling roll 1 in the shown embodiment) by a press roll 5 disposed downstream of the kissing point "a" and having a pressing surface geometry preliminarily determined in accordance with the cooling roll crown and the cast strip crown as shown in FIG. 4(*a*). In this situation, the cooling roll 1 is contracted, to provide a sharper crown $C_{RO}$ of FIG. 2.

The term "pressing surface geometry" as used herein means the geometry of the rolling surface of the press roll 5 in the portion in contact with the cast strip 4 when the press roll 5 is pressing the cast strip 4 against the cooling roll 1. For this purpose, the press roll 5 may be a crown roll having a necessary roll crown as shown in FIG. 4(*a*) or a straight roll capable of being bent to a necessary roll crown as shown in FIG. 4(*b*). A crown roll such as shown in FIG. 4(*a*) also may be bent as in FIG. 4(*b*), in accordance with need. The roll crown and the bending amount of the press roll 5 are determined by preliminary experiment and depend on parameters including the cooling roll geometry (crown, etc.) and size (roll width, etc.), the press roll diameter, and the cast strip crown.

Thus, the present inventive method ensures a metal contact of the entire cast strip width with a cooling roll surface by pressing the cast strip against the cooling roll surface with a press roll having a pressing surface geometry determined in accordance with the cooling roll crown and the cast strip crown, and therefore, enables a cast strip to be rapidly and uniformly cooled over the entire width thereof.

EXAMPLES

EXAMPLE 1

A 2 mm thick, 800 mm wide cast strip 4 of JIS SUS 304 stainless steel was cast by a vertical type twin-roll continuous caster, partially shown in FIG. 3, provided with a crowned press roll 5 shown in FIG. 4(*a*), according to the present invention.

The cooling roll 1 had a diameter of 1200 mm, a width of 800 mm, and a crown of 150 μm, and the press roll 5 had a diameter of 40 mm, a width of 800 mm, and a crown amount of 50 μm.

The casting temperature was 1500° C. In this case, the press roll crown was determined on a basis of the fact that the temperature of the cooling rolls 1 and 2 at the kissing point was 350° C. and that the cooling roll surface at the center of the roll length is shifted inward by 100 μm for a roll rotation of from the kissing point "a" to a pressing point "b" of FIG. 3 located 250 mm downstream of the kissing point "a".

EXAMPLE 2

A JIS SUS 304 stainless steel cast strip having the same size as that in Example 1 was cast according to the present invention, under the same conditions as in Example 1, except that the pressing of the cast strip 4 was effected by bending a straight press roll shown in FIG. 4(*b*), the bending amount being 50 μm when measured at the center of the press roll length.

COMPARATIVE EXAMPLE 1

A JIS SUS 304 stainless steel cast strip having the same size as that in Example 1 was cast by using the straight press roll 5 of Example 2, and under the same conditions as in Example 2, except that the press roll was not bent.

COMPARATIVE EXAMPLE 2

A JIS SUS 304 stainless steel cast strip having the same size as that in Example 1 was cast by a conventional vertical type twin-roll continuous caster, partially shown in FIG. 1 which was not provided with a press roll, under the same casting conditions as in Example 1.

The cast strips produced in Examples 1 and 2 and Comparative Examples 1 and 2 were examined for the distribution of the average γ-grain size along the strip width. The results are summarized in Table 1.

TABLE 1

| | Average γ-grain size (μm)* | | |
|---|---|---|---|
| Measuring position | Side edge of strip | ¼ width of strip | ½ width of strip |
| Inventive Example 1 | 50–70 | 50–70 | 50–70 |
| Inventive Example 2 | 50–70 | 50–70 | 50–70 |
| Comparative Example 1 | 50–70 | 150 or more | 150 or more |
| Comparative Example 2 | 150 | 150 or more | 150 or more |

TABLE 1-continued

| | Average γ-grain size (μm)* | | |
|---|---|---|---|
| Measuring position | Side edge of strip | ¼ width of strip | ½ width of strip |
| | or more | | |

*Average γ-grain size: The grain number was counted by using an optical microscope at a magnification of 100, and the average γ-grain size was calculated by converting the thus-obtained grain number under the assumption that the γ-grains are globular.

It can be obviously seen from the above results that the present invention prevents a coarsening of the solidified structure of a cast strip over the entire strip width, so that the average γ-grain size is far less than the 100 μm which is a critical value for preventing the occurrence of the roping during cold rolling.

In Comparative Example 1, grain coarsening was prevented only in the side edge portion at which a rapid cooling was effected by a metal contact with a cooling roll, but grains were coarsened over the intermediate portion of the strip width, i.e., over the substantial portion of a cast strip.

In Comparative Example 2, grains were coarsened over the entire width of cast strip, because a rapid cooling by a metal contact was not effected.

Although the above Examples describe the rapid cooling effect achieved by the present invention for JIS SUS 304 stainless steel, which is a Cr-Ni stainless steel, the present invention is not limited to Cr-Ni stainless steels but can be also generally applied to other types of stainless steels.

As herein described, when casting a stainless steel strip by using a vertical type twin-roll continuous caster, the present invention provides a method of cooling a cast stainless steel strip rapidly and uniformly over the entire strip width, successively from the strip solidification completion at a kissing point and over a temperature range in which the growth of solidified grains of the strip is accelerated, to prevent a coarsening of the solidified structure of a cast strip, and thereby effectively prevent surface defects such as a roping of the final cold-rolled steel strip product.

We claim:

1. A method of rapidly and uniformly widthwise cooling a cast stainless steel strip when casting the strip by using a vertical type twin-roll continuous caster provided with a pair of cooling rolls having an outer circumferential surface composing a casting mold wall moving synchronously with the cast strip, which comprises the step of:

pressing a cast strip having left a kissing point between the cooling rolls against the circumferential surface of one of the cooling rolls with a press roll disposed downstream of the kissing point and having a press roll surface geometry predetermined in accordance with a cooling roll crown and a cast strip crown, to rapidly cool said cast strip over the entire strip width successively from the strip solidification completion and over a temperature range in which the growth of solidified grains of the strip is accelerated.

2. A method according to claim 1, wherein said cast strip has a thickness of from 1 to 10 mm.

3. A method according to claim 1, wherein said press roll is a crown roll.

4. A method according to claim 1, wherein said press roll is a straight roll and is bent to provide said surface geometry.

* * * * *